US006918149B2

(12) United States Patent
Gowaty

(10) Patent No.: US 6,918,149 B2
(45) Date of Patent: Jul. 19, 2005

(54) SITTING SQUARE BABY SUPPORT CUSHION

(75) Inventor: Diane B. Gowaty, 1017 Franklin Ct., Jefferson Hills, PA (US) 15025

(73) Assignee: Diane B. Gowaty, Jefferson Hills, PA (US)

( * ) Notice: Subject to any disclaimer, the term of this patent is extended or adjusted under 35 U.S.C. 154(b) by 0 days.

(21) Appl. No.: 10/823,467

(22) Filed: Apr. 13, 2004

(65) Prior Publication Data

US 2004/0261181 A1 Dec. 30, 2004

Related U.S. Application Data

(60) Provisional application No. 60/462,531, filed on Apr. 14, 2003.

(51) Int. Cl.[7] ..... A47C 16/00
(52) U.S. Cl. ..... 5/655; 5/655.9; 5/953
(58) Field of Search ..... 5/655, 655.9, 740, 5/953, 425, 427, 922

(56) References Cited

U.S. PATENT DOCUMENTS 4,980,937 A * 1/1991 Mason et al. ..... 5/655
5,813,066 A * 9/1998 Gebhard et al. ..... 5/655
5,822,817 A * 10/1998 Carew et al. ..... 5/732
5,937,465 A * 8/1999 Carew et al. ..... 5/732
5,963,998 A * 10/1999 Carew et al. ..... 5/655
6,026,525 A * 2/2000 Davis ..... 5/99.1
6,199,230 B1 * 3/2001 Parikh ..... 5/420

OTHER PUBLICATIONS

Gershman, Maurice, M.D. "Self–Adhering Nylon Tapes." Journal of A.M.A. (vol. 168, No. 7) Oct. 18, 1958.*

* cited by examiner

*Primary Examiner*—Robert G. Santos

(57) ABSTRACT

This invention is a infant and child polyurethane foam 24" square support cushion with a 12" square center cut-out well region in which the child sits who needs help sitting up unsupported at rest or play or to learn how to support self on knees while learning how to crawl. This invention offers the new concept of offering a firmer, more durable cushion that supports children with four surrounding 5" high sides that do not allow the child to fall over and that teach the child how to support self in a seated position or a crawling position.

2 Claims, 1 Drawing Sheet

DRAWINGS
Fig. 1: Top View
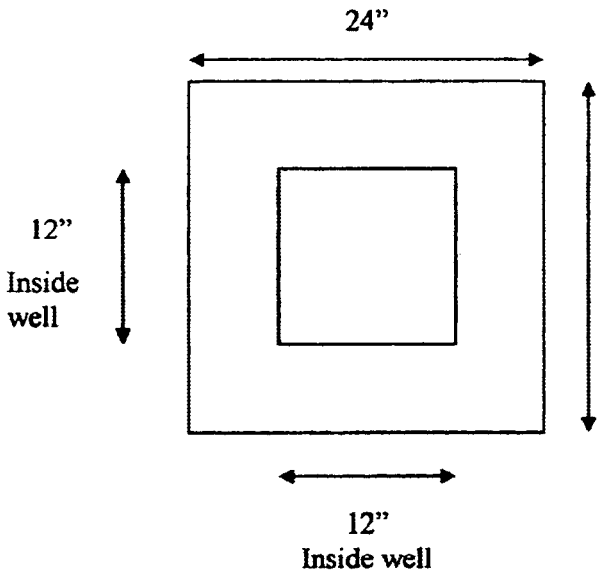
Fig. 2: Side View
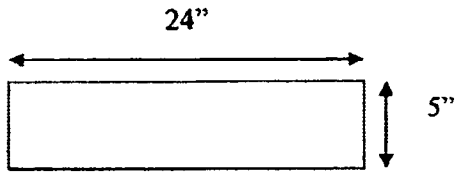
Fig. 3: Front View
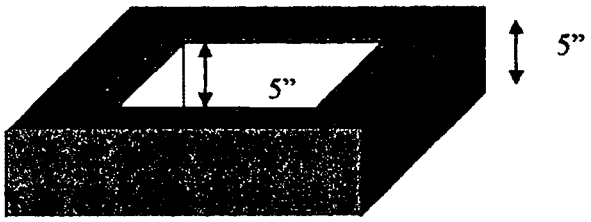
Fig. 4: Front View of Cover
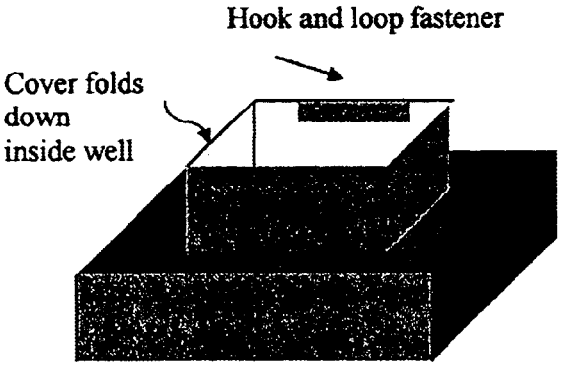
Legend
1" = 1'

SITTING SQUARE BABY SUPPORT CUSHION

CROSS-REFERENCE TO RELATED APPLICATIONS

This invention was filed under a provisional patent application on Apr. 14, 2003, application No. 60/462,531

STATEMENT REGARDING FEDERALLY SPONSORED RESEARCH OR DEVELOPMENT

Not Applicable

REFERENCE TO SEQUENCE LISTING

Not Applicable

BACKGROUND OF INVENTION

This invention pertains to the field of support pillows and cushions, and in particular to support pillows and cushions that are suitable for placement around an object, in this case, a baby's and child's head, neck, and body. The U.S. patent Classification would be Class 5 BEDS, relating to devices intended to hold the human body in a prone, supine, or sitting position. The subclass would be 652 SUPPORT FOR USER'S BODY OR PART THEREOF, which includes "cushions" and art that requires some modification to materials to adapt them for body support.

There are a number of other baby support pillows and cushions that provide support to the child's neck or body, however, only one was found that provides similar support that pertains to this invention by Susan Matthews, Application number 944629, filed Sep. 14, 1992, class 5/655. Susan Matthew's invention is a tubular-shaped, oval pillow to support the child in a laying position or seated position, which also supports the child's back and/or arms while at rest or play. The problems with this support pillow is that the infant is not firmly supported by a 5" high firm foam cushion, which allows the infant to flop over sideways, nor does it provide a front support for the child who falls over frontwards. Other support pillows only provide support to the head and neck. Specifically, U.S. Pat. No. 4,679,262 (Davis), U.S. Pat. No. 4,285,081 (Price), U.S. Pat. No. 2,167,622 (Bentivoglio), U.S. Pat. No. 4,788,728 (Lake). A pillow designed for the support of infants and small children while asleep in a sitting position is disclosed in U.S. Pat. No. 4,726,085 (Antonio). This device supports only the head, not any other portion of the infant's body.

BRIEF SUMMARY OF INVENTION

This baby and child support cushion provides support on all four sides of the infant and child needing support to sit up or when learning how to crawl. It contains a center well in which the child sits, with four, flat surrounding 5 inch high, 6 inch wide surfaces on which the child can rest its head and neck when lying down or back and arms when sitting up or on which to rest toys.

BRIEF DESCRIPTION OF THE SEVERAL VIEWS OF THE DRAWING

The foregoing features and advantages of the invention will be come more fully understood from the following description of the preferred embodiment of the invention as illustrated in the accompanying drawings in which like reference characters refer to the same parts throughout different views. The drawings are drawn to the following scale: 1 inch equals 1 foot.

FIG. 1 is a top perspective view of the square foam cushion with the following dimensions: 24" wide by 24" long, with a center hole region measuring 12" wide by 12" long. The top surface region measures 6" wide on each one of the four top surface areas.

FIG. 2 is a side view of the square foam cushion with the following dimensions: 24" long, 5" high. Each side measures the same.

FIG. 3 is a front view of the square foam cushion with the same dimensions described in FIGS. 1 and 2 showing the center cut-out well and inner sides of the well, which also measure 5" high all around.

FIG. 4 is a front view of the cover showing how the cover secures all around the inside perimeter with Velcro enclosures.

DETAILED DESCRIPTION OF THE INVENTION

A support cushion comprises a one-piece flame-retardant, polyurethane foam cushion body with the following dimensions: 24" square, 5" high, with a center 12" square cut-out region. A removable cover is disposed about the cushion body securing at the inside of the inner 12" square cut-out well by Velcro.

Previous inventions contained cotton filling stuffed within a tubular, oval or c-shaped pillow lacking firm support and complete surrounding support.

I claim:

1. A support cushion comprising: a polyurethane 24" square one-piece cushion body 5" high comprising a 12" square center cut-out extending from the top surface to the bottom surface of the cushion in order to support an infant and child who cannot sit up unsupported, that firmly supports an infant's and child's neck when lying, and back and arms all on four sides when seated and a cover cotton disposed about the cushion body, wherein the cotton cover wraps completely around the entire surface of the cushion securing in the center well along all four sides by a hook and loop fastener, such as that sold under the Trademark of Velcro, enclosure.

2. A support cushion as in claim 1 wherein said cushion that also provides a safe rest-shaped well in which infant and child sits while playing with toys prior to learning how to crawl, who needs a soft, firm object to rest on while positioned up on knees, who needs a soft, firm, low to the ground object to sit on when needing a seat with feet positioned resting on the floor either inside the square or outside the square, and who needs a soft, firm cushion to lay on.

* * * * *